US005189345A

United States Patent [19]

Branston et al.

[11] Patent Number: 5,189,345

[45] Date of Patent: Feb. 23, 1993

[54] GAS-DISCHARGE SWITCH

[75] Inventors: David-Walter Branston, Igelsdorf; Jan Stroh, Erlangen, both of Fed. Rep. of Germany

[73] Assignee: Siemens Aktiengesellschaft, Berlin & Munich, Fed. Rep. of Germany

[21] Appl. No.: 871,992

[22] Filed: Apr. 22, 1992

[30] Foreign Application Priority Data

Apr. 25, 1991 [EP] European Pat. Off. ..... 91106732.0

[51] Int. Cl.[5] ..... H01J 17/00; H01T 2/00

[52] U.S. Cl. ..... 315/326; 315/111.01; 313/306; 313/590

[58] Field of Search ..... 315/111.01, 326, 330, 315/334, 335, 337, 339; 313/231.41, 306, 581, 590

[56] References Cited

U.S. PATENT DOCUMENTS

| | | | |
|---|---|---|---|
| 4,939,416 | 7/1990 | Seeboeck et al. | 313/590 |
| 5,055,748 | 10/1991 | Reinhardt | 315/335 |
| 5,091,819 | 2/1992 | Christiansen et al. | 313/306 |
| 5,126,638 | 6/1992 | Dethlefsen | 315/326 |

OTHER PUBLICATIONS

Japanese Journal of Applied Physics, vol. 29, No. 2T2, Feb. 1990, pp. L371-L374: The Pseudospark Switch—A High-Voltage Gas Discharge Switch for High-Power Applications, Axel Tinschmann et al.

J. Phys. E.: Sci. Instrum., vol. 19 (1986), pp. 466-470: High repetition rate, fast current rise, pseudo-spark switch, Mechtersheimer et al.

Proc. VII Int. Conf. Phenom. In Ionized Gases, Belgrad, 1965, vol. 1, pp. 316-326, M. J. Schönhuber.

*Primary Examiner*—Robert J. Pascal

*Attorney, Agent, or Firm*—Kenyon & Kenyon

[57] ABSTRACT

A gas-discharge switch for a low-pressure gas discharge contains at least two main electrodes. A distance d between the main electrodes and the pressure p of a working gas are selected so as to allow the igniting voltage to diminish with a rising product p×d. A hollow electrode, which is connected to a trigger voltage source, is allocated to the discharge gap. This hollow electrode is connected via an an anode resistor to the anode. Preferably, the hollow electrode can be additionally connected via a resistor to the cathode. With this refinement of the firing device, one achieves a preionization inside the hollow electrode and a corresponding simplification of the firing device.

5 Claims, 1 Drawing Sheet

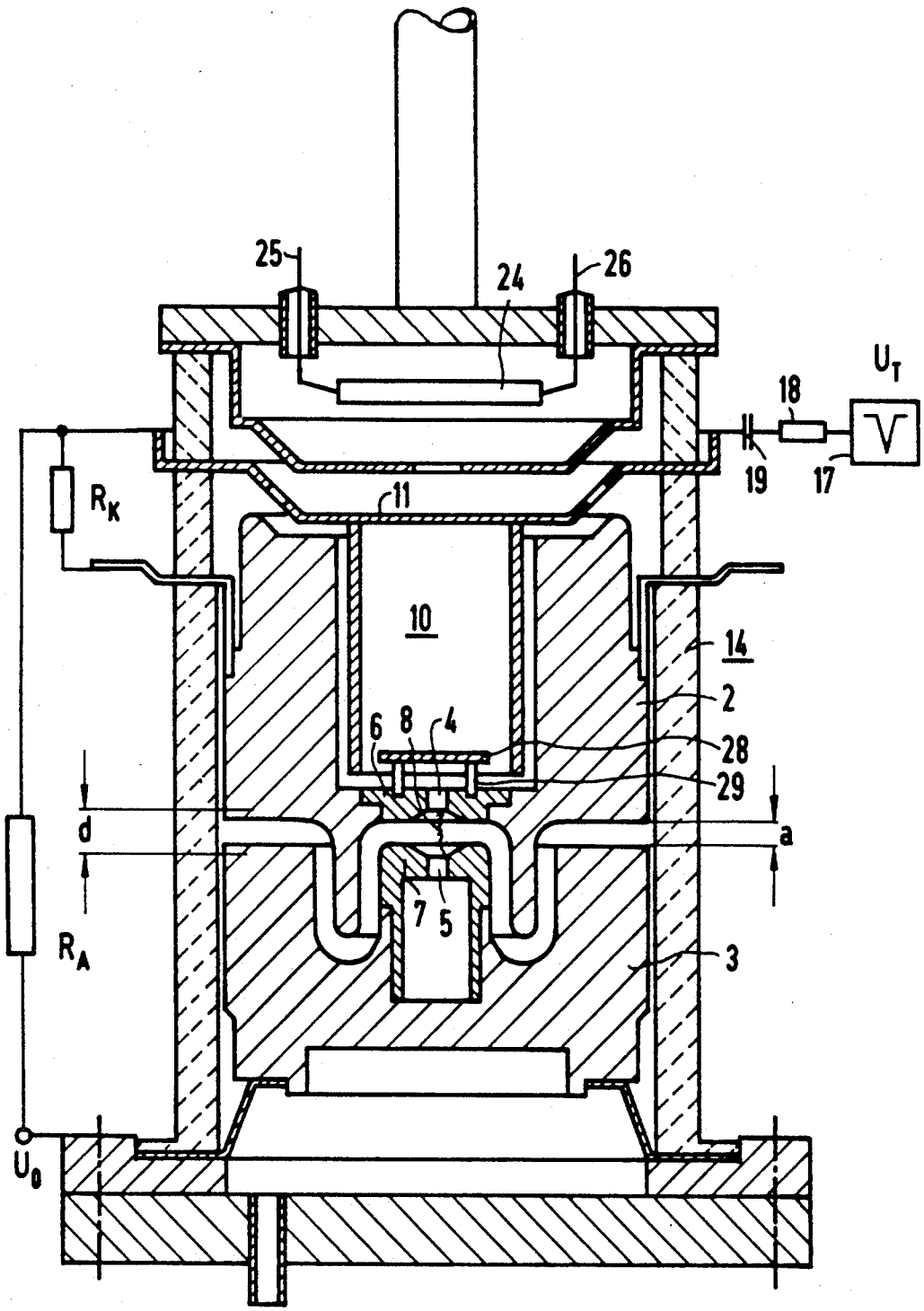
25
24
26
$U_T$
18
19
17
$R_K$
11
10
14
2
6
8
4
28
29
d
a
7
5
$R_A$
3
$U_0$

GAS-DISCHARGE SWITCH

BACKGROUND OF THE INVENTION

The present invention relates to a low pressure gas-discharge switch containing at least two main electrodes. These main electrodes are disposed at a distance d from each other in an arcing chamber and constitute one cathode and one anode of a discharge gap for the low-pressure gas discharge. The low-pressure gas discharge is ignited by increasing the electron density in the rear cathode space. The arching chamber contains an ionizable gas filling having a pressure p which is selected so as to allow the igniting voltage of the low-pressure gas discharge to diminish as the product $p \times d$ (i.e, pressure x distance) increases.

The usual graphic representation of the gas-discharge gap's control characteristic, the igniting voltage in dependence upon the product of the gas pressure p and the electrode spacing (i.e., anode-to-cathode distance) d, constitutes an important aid for characterizing electric discharge units when the firing probability considered. When the dielectric strength of a given gas-discharge gap is determined, generally the infinitely larger plate-type capacitor and its control characteristic are drawn upon for comparison. However, the practical specific embodiment of such discharge gaps has electrodes with finite dimensions. While determining the right hand branch of the ignition characteristic (Paschen curve) inclusive of the voltage minimum, merely arranging two flat, rounded-off plates, possibly provided at the edges with a so-called Rogowski profile, parallel to one another is sufficient. However, such an arrangement is useless for analyzing control characteristics in the left part of the Paschen curve, since indirect (i.e., diverted) discharges can occur then.

Such indirect or diverted discharges can be avoided by using an electrode construction with plate electrodes disposed coaxially to one another, bent away from one another at their edges with a radius of curvature that is small relative to the electrode spacing, and supported along the inner cylindrical insulator surface. Thus, a gap is always formed between the bent, cylindrical edge area of the electrodes and the inner wall of the hollow-cylindrical insulator. This specific embodiment of a low-pressure gas-discharge gap enables the control characteristic to be determined, for example, for different inert and molecular gases in the near-strike range as well (i.e., left of the minimum of the Paschen curve) (see *Proc. VIIth Int. Conf. Phenom. in Ionized Gases*, Beograd 1965, vol. 1, pp. 316–326).

Gas-discharge switches controlled by a pulsed low-pressure gas discharge are also known. They operate currents of 10 kA, for example, at a voltage of 20 kV. Such a discharge switch contains an anode and a cathode, each being provided with coaxial openings. Each are separated from one another at the edge by a ring-shaped insulator. A controlling device is provided for the gas discharge. It contains an electrode with a cage-like construction often described as a hollow electrode. The hollow electrode is connected in an electrically conductive manner to the cathode and is thus connected to the cathode potential. It encircles the rear cathode space and separates it from an area of a pre-ionization. The gas discharge between the cathode and the anode is fired by injecting charge carries. The discharge gap is ignited in two steps: first a pre-ionization is produced by an auxiliary electrode through a glow discharge. Subsequently, a trigger electrode receives a negative firing pulse, and the entry of charge carries into the cage-type electrode is permitted because the potential of a blocking electrode is set to zero. The discharge is introduced with the entry of the charge carriers into the cage-type electrode (see *J. Phys. E: Sci. Instr.* 19 (1986), The Inst. of Physics, great Britain, pp. 466–470 or *Japanese Journal of Applied Physics* 29 (1990) February, no. 2, part 2, Tokyo, JP, pp. L 371–374).

SUMMARY OF THE INVENTION

The present invention seeks to simplify and improve this known specific embodiment of a gas-discharge switch for a low-pressure gas discharge. In particular, the present invention simplifies the firing device used for this switch.

The present invention achieves this simplification by replacing the cage-like hollow electrode, the auxiliary electrode and the trigger electrode by a single hat-shaped control electrode. The control electrode has an opening which faces the discharge gap. The control electrode is separate from the cathode and is connected to a trigger voltage source. The control electrode is connected via an anode resistor $R_A$ to the anode. Preferably, the control electrode can also be connected via a cathode resistor to the cathode.

In addition, the firing device can also be improved by providing the main electrode facing the control electrode at the discharge gap with an opening and by configuring a baffle plate for the ion current of the low-pressure gas discharge between this opening and the control electrode.

BRIEF DESCRIPTION OF THE DRAWING

The FIGURE is an exemplified embodiment of a gas-discharge switch schematically illustrated according to the present invention.

DETAIL DESCRIPTION

In the specific embodiment depicted in the FIGURE, the gas-discharge switch contains two main electrodes. One is operated as a cathode 2 and the other as an anode 3. The cathode 2 is provided with at least one opening 4 leading to a rear cathode space. In addition, the anode 3 can also be provided, correspondingly, with at least one opening 5 leading to a rear anode space. The discharge gap 8 is ignited through the two openings 4 and 5. The cathode 2 and the anode 3 generally each form a rotating body. They are arranged with a pre-set clearance a from one another, for example to about 2 to 5 mm. Around the bore holes 4 and 5, at least one of the surfaces of the cathode 2 and the anode 3 facing each other is provided with a tapered recess, which widens the clearance between the electrodes 2 and 3 at the discharge gap 8. The clearance d can preferably amount to between 2 to 10 mm and more preferably between 3 to 8 mm. The cathode 2 and the anode 3 consist of electrically conductive material, preferably high-grade steel, and can generally also be provided at the discharge gap 8 with special inserts 6 and 7 of a high melting point metal. Alternately, the cathode 2 and anode 3 can be made entirely of this high melting point metal. Preferably, the diameter of the openings 4 and 5 is selected to be not more than and, in particular, smaller than the clearance d between the electrodes 2 and 3 at the discharge gap 8. The cathode 2 and the anode 3 are configured in an arcing chamber 14, whose hollow-cylindrical housing consists of electrically insulating material, preferably a ceramic.

A hat-shaped control electrode 10 having an opening is configured in the arcing chamber 14 so as to allow its opening to face the discharge gap 8. The control electrode 10 is part of the trigger device for the discharge gap 8. The rear cathode space is surrounded, in particular, in the manner of a hollow body by the hat-shaped control electrode 10 so that the control electrode 10 is also described in the following as a hollow electrode. A positive voltage $U_O$ of, for example, about 40 kV is to be applied to the anode 3. The hollow electrode 10 consists of an electrically conductive material, for example high-grade steel, and at the least is shaped like a bowl, preferably a pot, having a depth T which is greater than the length of the cathodic dark space of a glow discharge. A lateral, flange-type extension of the base 11 in the form of a profile ring is provided with openings to allow the admission of a working gas.

The gas filling consists of an ionizable gas, preferably hydrogen or deuterium, or a mixture of these gases. Furthermore, nitrogen or inert gases, such as argon or helium may also be used.

A trigger voltage source 17 for a negative trigger voltage $U_T$, is connected to hollow electrode 10 and is preferably connected via a limiting resistor 18 and a decoupling capacitor 19 to the hollow electrode 10. The trigger voltage source 17 supplies a trigger pulse with a steep rising edge and a negative voltage of, for example, about 0.5 to 10.0 kV, preferably about 1 to 5 kV referred to the potential of the cathode 2, which can be ground, for example. The length of the trigger pulse is at least as great as the switching delay of the discharge gap 8 and can amount, for example, to about 0.1 to 2.0 μs, preferably about 0.5 to 1.0 μs. Generally, the arcing chamber 14 also contains a gas storage unit 24 for the working gas (indicated only schematically in the FIGURE), which is provided with a heating device (not depicted in greater detail in the FIGURE) and electrical terminals 25 and 26.

According to the present invention, a pre-ionization inside the hollow electrode 10 can be produced by connecting the hollow electrode 10 via an anode resistor $R_A$ to the anode 3. In this specific embodiment, a pre-ionization, which only burns during the critical time, is produced inside the hollow electrode 10. With a switching voltage of, for example, 40 kV and a pre-ionization current of, for example, about 0.1 to 1.0 mA, one can select an anode resistance $R_A$ of, for example, about 40 to 400 MOhm, preferably about 100 to 200 MOhm.

In another particularly advantageous embodiment, to limit voltage, the hollow electrode 10 can be additionally connected via a cathode resistor $R_K$ to the cathode 2 in such a way that a voltage divider is formed from the two resistors $R_A$ and $R_K$, with the hollow electrode 10 as a tapping point. An adequate voltage limitation is obtained with a cathode resistance $R_K$ of about 5 to 50 MOhm.

Configuring a baffle plate 28 between the bore hole 4 of the cathode 2 and the hollow electrode 10 forces an earlier commutation to the cathode 2 as a result of the impingement of the ion beam during the discharge. Therefore, a voltage rise across the hollow electrode 10 cannot occur.

The baffle plate 28 consists of electrically conductive, preferably arc-resistant material, and is connected in an electrically conductive manner to the cathode 2 and, with the help of spacers 29, is arranged with pre-set clearance above the bore hole 4.

What is claimed is:

1. A gas-discharge switching comprising:

a) a trigger voltage source;

b) an arcing chamber containing an ionizable gas filing;

c) a cathode, said cathode having a rear space and being disposed in said arcing chamber;

d) an anode, said anode being disposed in said arcing chamber with a discharge gap clearance (d) between said cathode and said anode;

e) an anode resistor $R_A$; and f) a hat-shaped control electrode, said control electrode surrounding said rear cathode space, having an opening facing the discharge gap, being separated from the cathode, being connected to a trigger voltage source, and being connected via an anode resistor $R_A$ to the anode, wherein a low-pressure gas discharge is ignited by increasing the electron density in the rear cathode space and wherein the arcing chamber contains an ionizable gas filling having a pressure p selected so as to allow the igniting voltage of the low-pressure gas discharge to diminish as the product $p \times d$ increases.

2. The gas-discharge switch according to claim 1, wherein the anode resistor $R_A$ is provided with a resistance of about 40 to 400 MOhm.

3. The gas-pressure switch according to claim 1, further comprising a cathode resistor $R_K$, wherein the control electrode is connected via said cathode resistor $R_K$ to the cathode.

4. The gas-discharge switch according to claim 3, wherein said cathode resistor $R_K$ is provided with a resistance of about 5 to 50 MOhm.

5. The gas-discharge switch according to claim 1, wherein the main electrode facing the control electrode is provided with an opening, and that a baffle plate for the ion beam of the low-pressure gas discharge is configured between the opening and the control electrode.

* * * * *